US011690440B1

(12) United States Patent
Flores

(10) Patent No.: US 11,690,440 B1
(45) Date of Patent: Jul. 4, 2023

(54) TOOL CUFF DEVICE AND METHOD OF USE

(71) Applicant: Jesse Flores, Moreno Valley, CA (US)

(72) Inventor: Jesse Flores, Moreno Valley, CA (US)

( * ) Notice: Subject to any disclaimer, the term of this patent is extended or adjusted under 35 U.S.C. 154(b) by 0 days.

(21) Appl. No.: 17/962,444

(22) Filed: Oct. 7, 2022

Related U.S. Application Data

(60) Provisional application No. 63/253,459, filed on Oct. 7, 2021.

(51) Int. Cl.
*A45F 5/02* (2006.01)
*A45F 5/00* (2006.01)
*B25H 3/00* (2006.01)

(52) U.S. Cl.
CPC ..... *A45F 5/021* (2013.01); *B25H 3/00* (2013.01); *A45F 2005/006* (2013.01); *A45F 2200/0575* (2013.01)

(58) Field of Classification Search
CPC ..... A45F 5/021; A45F 2200/0575
See application file for complete search history.

(56) References Cited

U.S. PATENT DOCUMENTS 6,102,264 A * 8/2000 Redzisz ..... A45F 5/02 224/904
10,299,573 B2 * 5/2019 Swims ..... A45F 5/00
2014/0262608 A1 * 9/2014 Patel ..... F16B 45/06 24/592.11

FOREIGN PATENT DOCUMENTS

WO WO-2016200896 A1 * 12/2016 ..... A45F 3/14

* cited by examiner

*Primary Examiner* — Jason L Vaughan
*Assistant Examiner* — Amanda Kreiling
(74) *Attorney, Agent, or Firm* — Grant's Law Firm; Allan Grant

(57) ABSTRACT

A tool attachment device and method of use designed to create a tool connection enclosure with an integral captive attachment point for securing tools without an integral captive attachment point. Tools without an integral captive attachment point such as hammers, spud wrenches, open-ended wrenches, and tapered handle tools commonly referred to as "waisted" or "necked" tool (tapered mid-section) present a challenge in securing tools for attachment of a connecting device such as carabiners, tool attachment or tool tethers.

21 Claims, 11 Drawing Sheets

TOOL CUFF DEVICE AND METHOD OF USE

CROSS-REFERENCE TO RELATED APPLICATIONS

The present application claims priority under 35 U.S.C. 119(e) and under all applicable U.S. statutes and regulations, to U.S. Provisional Application Ser. No. 63/253,459 filed Oct. 7, 2021. The disclosure of which is hereby incorporated herein by reference in its entirety.

FIELD OF THE INVENTION

The present invention relates generally to a tool cuff safety accessory device for providing a secure attachment point for a handheld tool and a method of using the device.

BACKGROUND OF THE INVENTION

On construction sites, a common cause of injuries is heavy handheld tools (e.g. wrench or crowbar) being dropped by workers from heights which strike their co-workers below. There are a number of existing prior art accessories including specialized tools having built in attachment points. However, such tools may be expensive, difficult to find, or simply unavailable. Other prior art accessories rely on attachments that may not be secure, resulting in the possibility that they may not be effective.

The high-rise construction industry and construction of tall structures pose risks when working with tools at heights. Tools dropped from an upper floor of a high-rise structures and buildings have resulted in damage, serious injury and in some cases death. Unsecured tools cause serious injury or death when dropped from height, these tools range from heavy tools such as impact hammers, power drills, and power saws to smaller light weight tools such as pliers, screw drivers, hammers, wrenches and other open-ended tools. In 2019 there were over 52,000 injuries and 278 fatalities as a result of dropped objects annually in the United States alone.

Tools with "closed handles" and tools with captive attachment points allow the end-user to connect to the tool using properly rated tool tethering equipment such as carabiners, tool attachments or tool tethers without the need to apply a "tool attachment" solution onto the tool first in order to create a attachment point. Tools without integral captive attachment points present challenges in tethering tools to prevent a dropped object. Examples of tools without integral captive attachment points are hammers, spud wrenches, striking hammers, tapered handle wrenches and waisted/necked tools.

Some tool attachment solutions for tools without captive attachment points consist of a tape application used in combination with a tool attachment usually made of nylon webbing and may include a D-Ring, or Loop as an attachment point that is taped onto the tool to attach a tool securing device such as a carabiner, tool attachment or tool tether. Its use is limited due to potential exposure to environmental elements, such as heat, cold, moisture, dirt and other debris which can affect the tapes' adhesive properties, performance, and life expectancy.

Other solutions consist of a shackle style tool attachment, its use is also limited as it requires the use of a thread lock solution and a set of pliers to tighten and ensure a good connection, either which may not be readily on-hand at the site. Therefore an easy to use, easy to apply tool attachment solution without the need of a tool to install is needed such that, when a applied to a tool creates a secure tool enclosure and a captive attachment point that can accommodate a variety of tools without integral captive attachment points such as hammers, spud wrenches, wrenches, and tapered handle waisted/necked tools that vary in size, weight and/or configuration.

The above information is only for the understanding of the background of the present disclosure.

What is needed is a new safety solution which provides an adaptable, secure attachment tool cuff safety accessory device point for a wide variety of tools at a relatively low cost.

What is also needed is a solution which provides an easy to use method for attaching and using an adaptable, secure attachment tool cuff device point for a wide variety of tools at a relatively low cost.

a tool cuff safety accessory for providing a secure attachment point for a handheld tool and a method of using the device.

SUMMARY OF THE INVENTION

The present invention addresses the above described safety problem by providing a tool safety accessory which may be securely installed onto a wide variety of handheld tools.

The present disclosure is directed to tool safety, particularly an improved safety accessory device and method of using said device.

It is an object of this invention to provide a tool cuff attachment safety accessory device for providing a secure attachment point for a handheld tool.

It is an object of this invention to provide a tool safety accessory device that includes an opening or hole for receiving a retaining means, such as locking hook attached to a safety lanyard, a steel cable or a nylon rope, to prevent the tool from being accidentally dropped.

It is a further object of this invention to provide a tool safety accessory device that is comprising of at least 2 inter-connecting pieces, a first connecting piece, and at least one additional connecting piece.

It is another object of this invention to provide a tool safety accessory device for tools comprising of a return or other locking mechanism to keep the inter-connecting pieces closed and attached to the tool when not in use.

It is an object of this invention to provide a tool safety accessory device is comprised of a tool attachment enclosure element and an attachment point element by coupling the first connecting piece and the second connecting piece together such that when joined, closed and applied to a tool create:

a) A tool connection enclosure for securing the attachment onto a tool; and b) An integral captive attachment point for connection with a properly rated carabiner, cord or loop tool attachment or tool tether.

Each inter-connecting piece is comprised of a lower coupling element for assembling the inter-connecting pieces together and an upper attachment point element for connection of carabiner, tool attachment or tool tether.

The assembly and attachment point elements are rigidly connected by structural member configured to couple the elements creating the tool enclosure of the tool attachment.

The tool attachment can be used to secure tools without captive attachment points such as waisted/necked tools by creating a tool connection enclosure to secure the tool and a captive integral attachment point that can be connected to with a properly rated carabiner, tool attachment or tool tether as part of a dropped object prevention safety program.

In the preferred embodiment of the invention, the tool safety accessory device is comprised of: a tool cuff having a minimum of two inter-connecting pieces that connects at one or more fulcrum(s) which swivel to open and closed for accepting, removing, and locking a hand tool onto the inside said tool cuff thereby creating an enclosure for securing said hand tool; said tool cuff has a locking mechanism for keeping said two inter-connecting pieces closed and attached to said hand tool when not in use; a mechanical stop which limits the opening distance of the swivel of said two inter-connecting pieces, which is used as a sizing tool for selecting the correct size of the tool cuff based on the size of the connecting position of said hand tool; and said tool cuff has hole for attaching a tether between a user and said user's hand tool.

The preferred method for accurately sizing one or more tool cuff device for use with a hand tool, the method comprising: providing a tool cuff having a minimum of two inter-connecting pieces that connects at one or more fulcrum(s) which swivel to open and closed for accepting, removing, and locking a hand tool onto the inside said tool cuff thereby creating an enclosure for securing said hand tool; said fulcrum has a locking mechanism for keeping said two inter-connecting pieces closed and attached to a connecting position of said hand tool; and said connecting position of said hand tool has a tapered section for allowing said tool cuff to hold, retain, and secure said hand tool; providing mechanical stop which limits the opening distance of the swivel of said two inter-connecting pieces, which is used as a sizing tool for selecting the correct size of the tool cuff based on the size of the connecting position of said hand tool; wherein said user opens said tool cuff by swiveling open said two inter-connecting pieces from one or more fulcrum(s) thereby creating an opening for accepting said hand tool and then said user can try to insert said hand tool into said tool cuff at said connecting position for accepting and retaining said hand tool; wherein a smaller tool cuff would produce a smaller opening distance when swiveled open for said two inter-connecting pieces to accept a smaller connecting position for said tool cuff on said hand tool; wherein a larger tool cuff would produce a larger opening distance when swiveled open for said two inter-connecting pieces to accept a larger connecting position for said tool cuff on said hand tool; wherein said user would select the size of said tool cuff by checking to see if said connecting position of said hand tool has said tapered section having a greater thickness than said tool cuff, if yes then said hand tool cannot be inserted into said tool cuff and said hand tool cannot be accepted and secured into said tool cuff and then said user has to select a different size for said tool cuff; wherein said user would select the size of said tool cuff by checking to see if said connecting position of said hand tool has said tapered section that has a less thickness than said tool cuff for retaining said hand tool then said hand tool can be inserted into said tool cuff and so said hand tool can be accepted into said tool cuff; wherein said hand tool can be accepted into said tool cuff then said user would also need select the size of said tool cuff by checking to see if said hand tool having said tapered section allows said tool cuff to hold, retain, and secure said hand tool where it is tapered in said connecting position, if yes then said user has selected the proper size of said tool cuff, if no then said user would need to select a different size of said hand tool having a smaller tapered portion for being retained by said tool cuff for holding, retaining, and securing said hand tool; and after said user has selected the proper size of said tool cuff, then said hand tool is inserted into said tool cuff and said tool cuff is closed by swiveling said two inter-connecting pieces from one or more fulcrum(s) for securing said hand tool into the inside said tool cuff thereby creating an enclosure for securing said hand tool.

It is an object of this invention to provide a wrist splint device having indicia, so the patients wearing these devices can fit in, in a work or social environment.

It is an object of this invention to provide a tool attachment safety solution device having indicia and/or bight colors, so the users attaching these devices can have them stand out in a work environment.

It is an object of this invention to create a tool attachment safety solution device that is easy to manufacture, reliable in operation, and relatively inexpensive to produce.

It is an object of this invention to create a tool cuff attachment safety solution device that is easy to use and reliable in operation.

In addition to the above objects, various other objects of this invention will be apparent from careful reading of this specification including the detailed description contained herein below.

BRIEF DESCRIPTION OF THE DRAWINGS

These as well as other features of the present invention will become more apparent upon reference to the accompanying drawings wherein like numerals designate corresponding parts in the several figures summarized as follows.

Other features and advantages of the invention will be become apparent from the following detailed description, taken in conjunction with the accompany drawings, which illustrate, by way of example, various features of the invention.

DETAILED DESCRIPTION OF THE PREFERRED EMBODIMENTS

The following detailed description and accompanying drawings are provided for purposes of illustrating and describing presently preferred embodiments of the present invention and are not intended to limit the scope of the invention in anyway. It will be understood that various changes in the details, materials, arrangements of parts or operational conditions which have been herein described and illustrated in order to explain the nature of the invention may be made by those skilled in the art within the principles and the scope of the invention.

Figure 1:
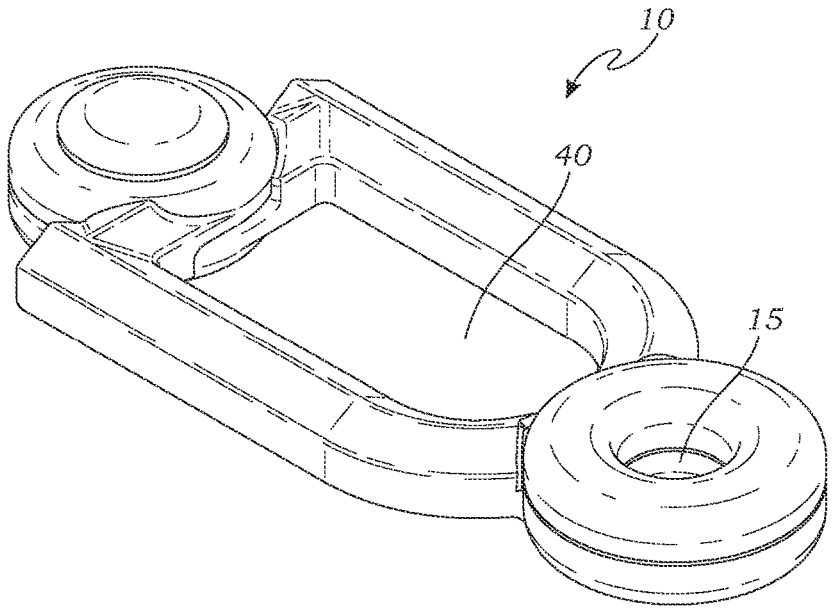
FIG. 1 is a prospective view of the invention a tool cuff safety accessory device.
Figure 2:
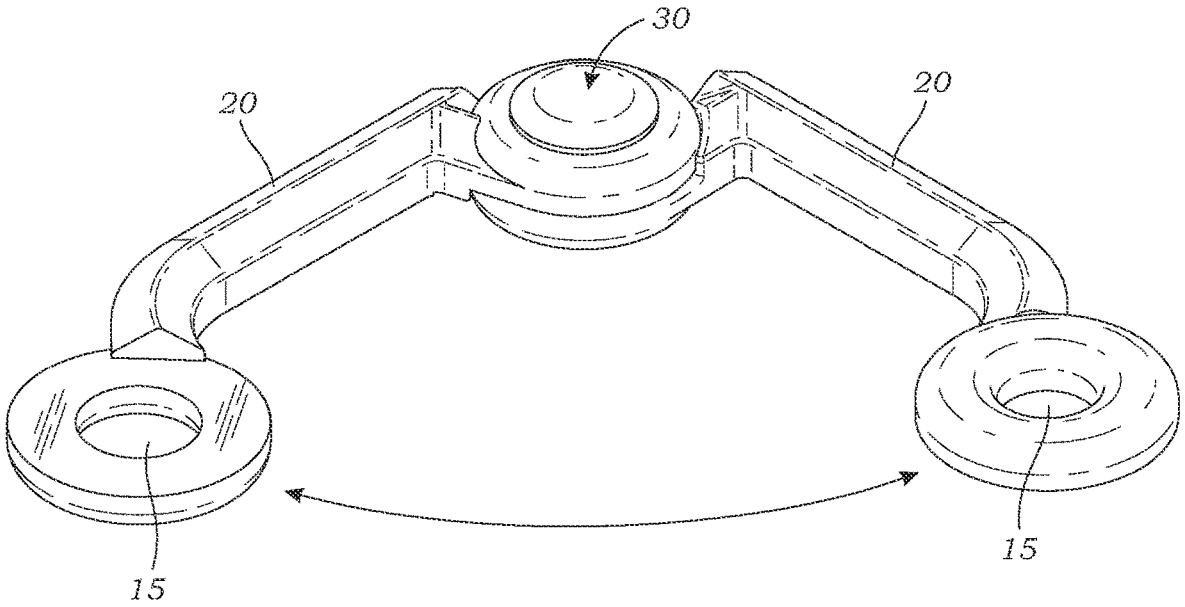
FIG. 2 is a prospective view of a tool cuff safety accessory device that has been swiveled open for receiving a tool.
Figure 3:
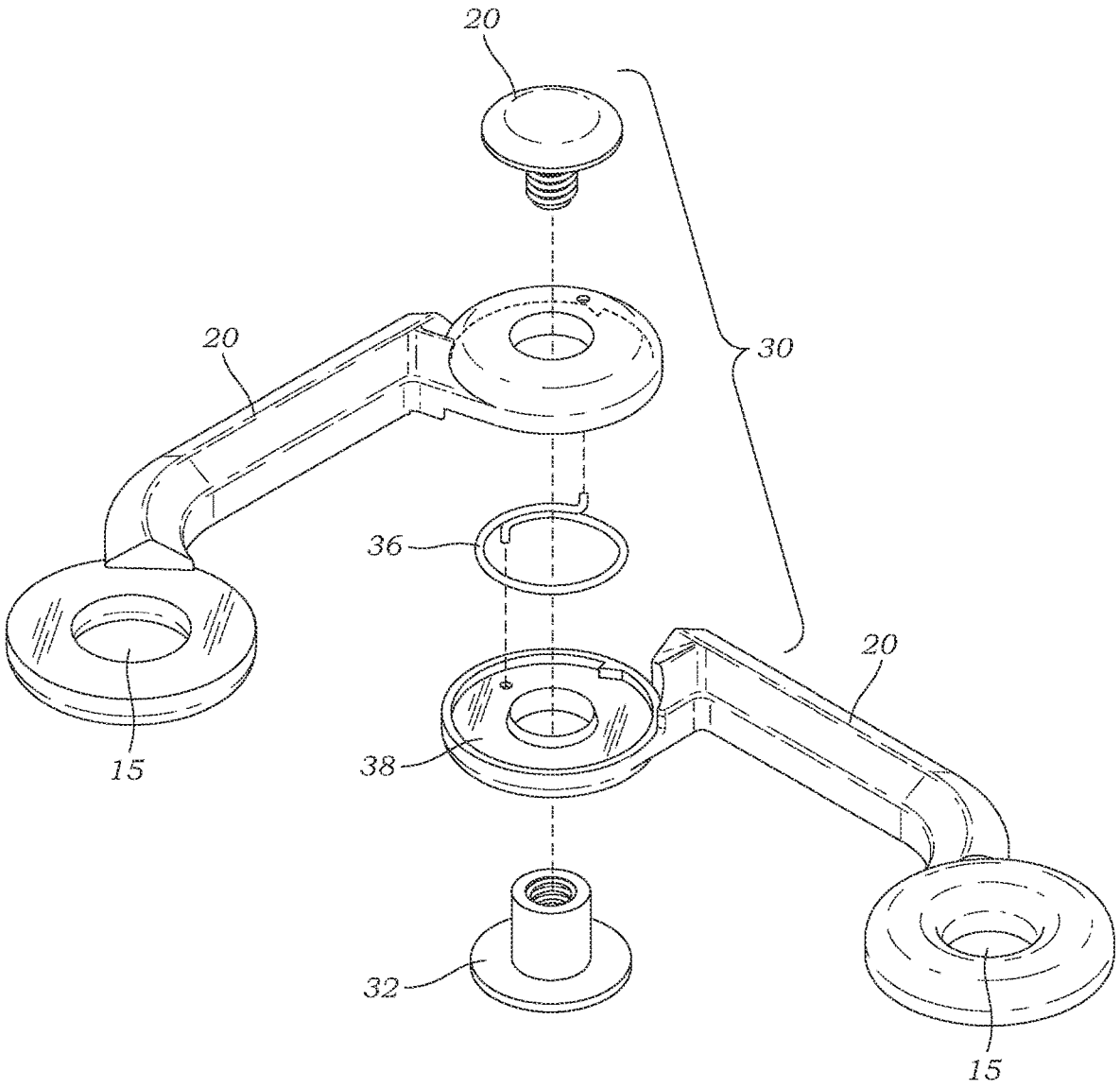
FIG. 3 is an exploded view of a tool cuff safety accessory device that has been swiveled open and that is showing the internal and external parts.
Figure 4:
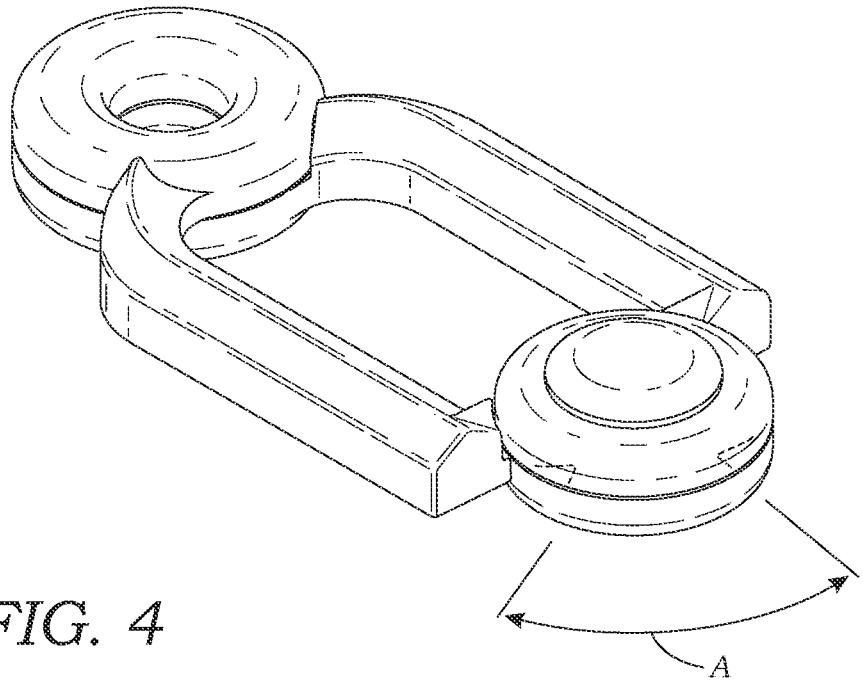
FIG. 4 is a prospective view of the invention a tool cuff safety accessory device having an internal stopping mechanism.
Figure 5:
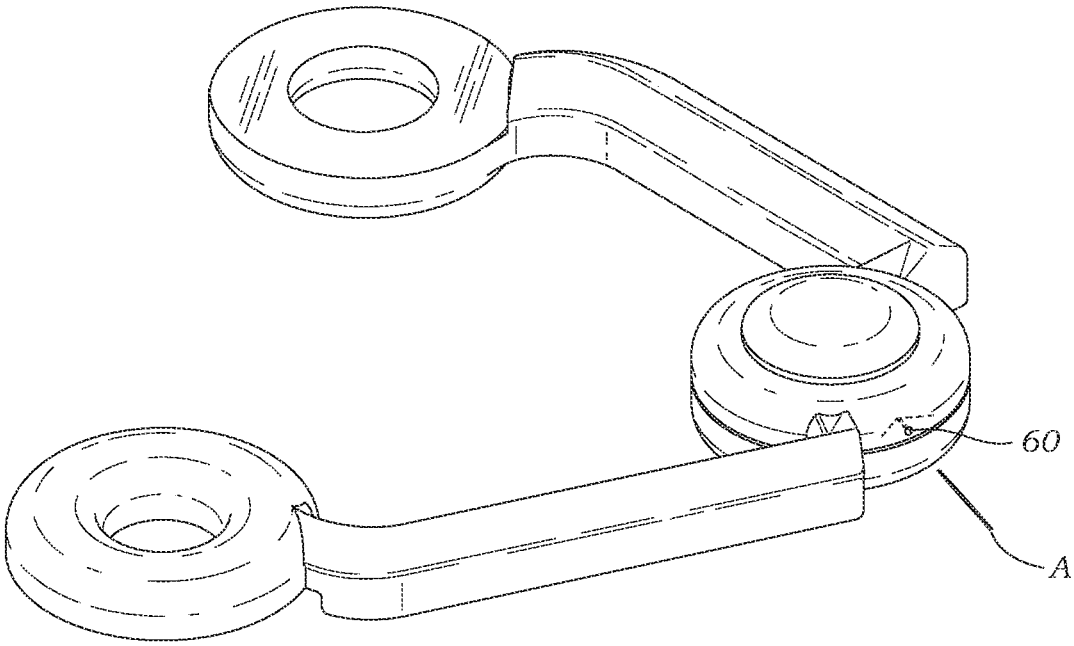
FIG. 5 is a prospective view of a tool cuff safety accessory device having an internal stopping mechanism that has been swiveled open for receiving a tool.
Figure 6:
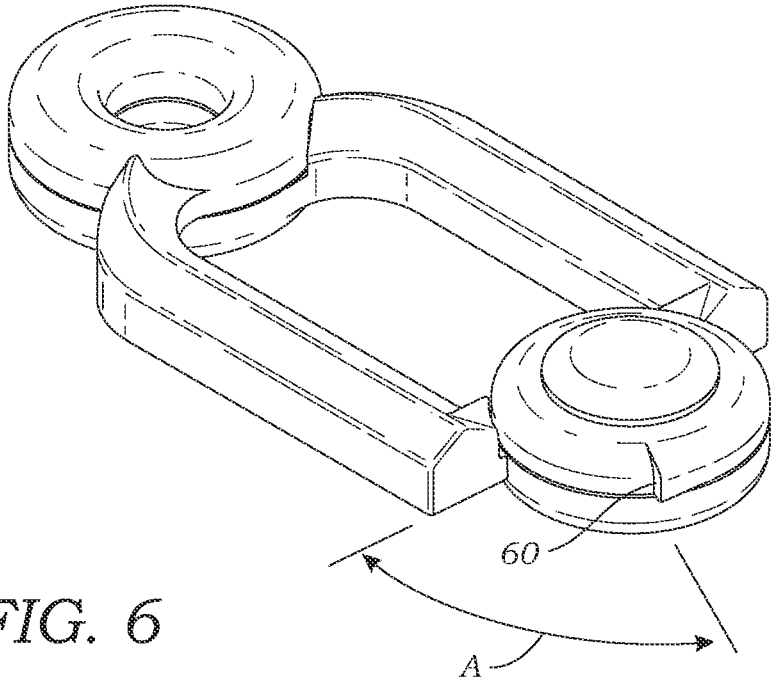
FIG. 6 is a prospective view of the invention a tool cuff safety accessory device having an external stopping mechanism.
Figure 7:
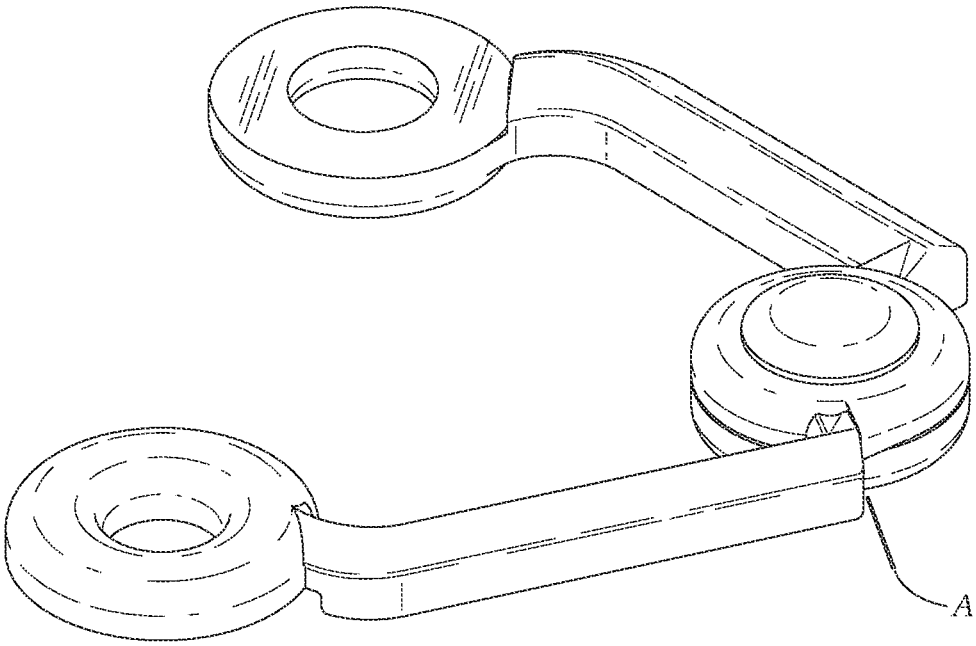
FIG. 7 is a prospective view of a tool cuff safety accessory device having an external stopping mechanism that has been swiveled open for receiving a tool.
Figure 8:
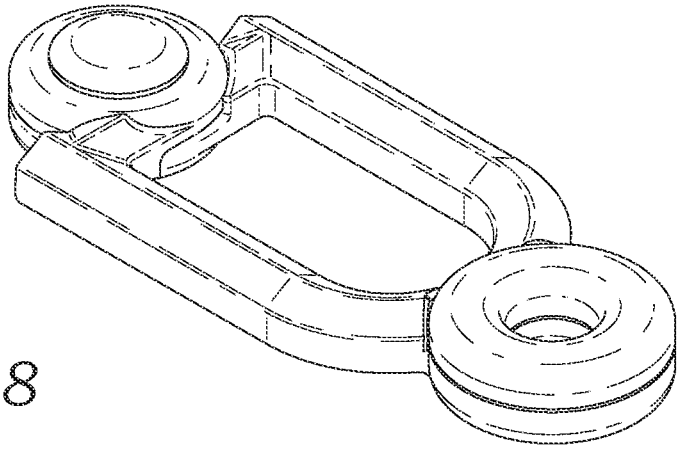
FIGS. 8-10 are prospective views of the tool cuff safety accessory device in different sizes and shapes.
Figure 9:
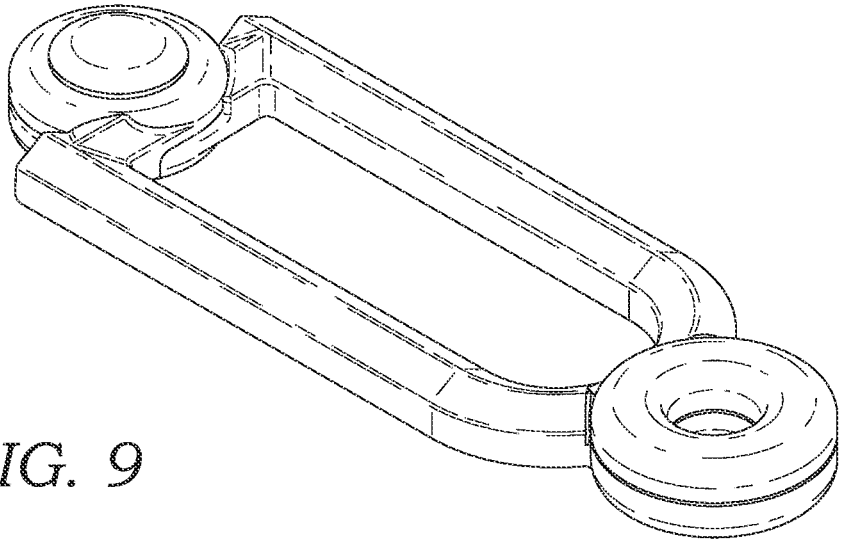
Figure 10:
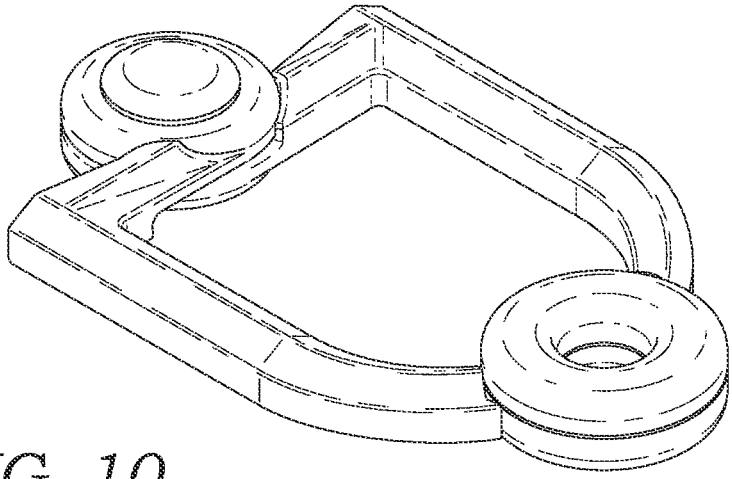
Figure 11:
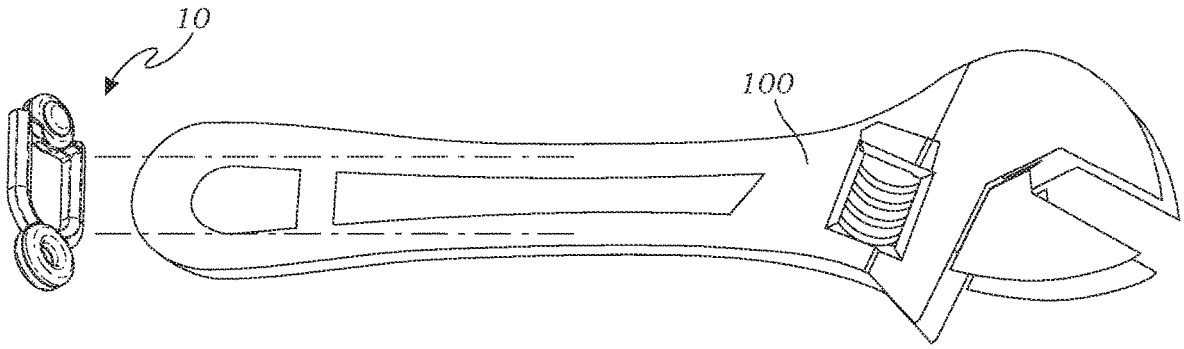
FIGS. 11-13 are prospective views of the tool cuff safety accessory device in different sizes and shapes for attaching to a tool, wherein the FIG. 13 is showing the device attached to a tool.
Figure 12:
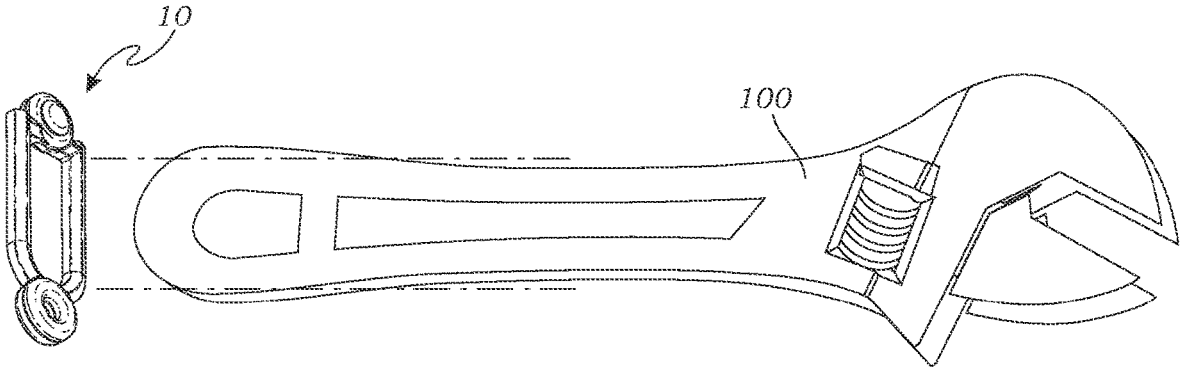
Figure 13:
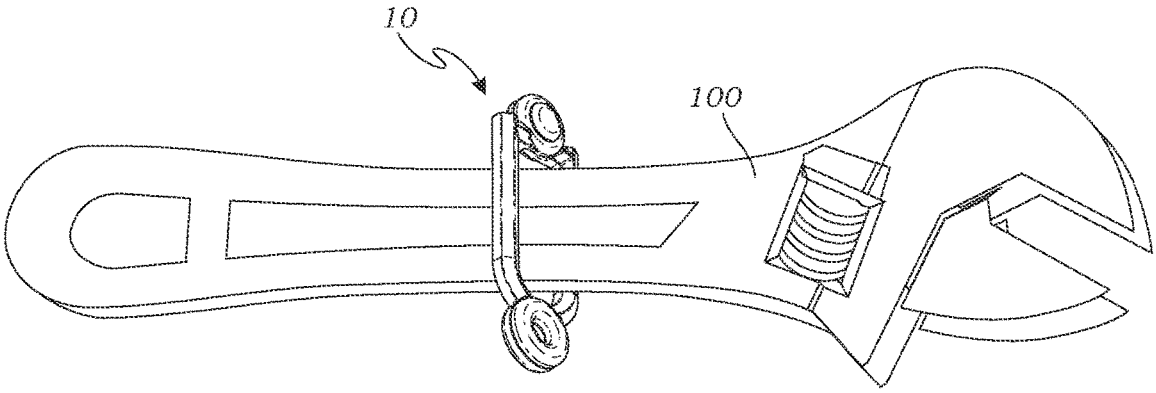
Figure 14:
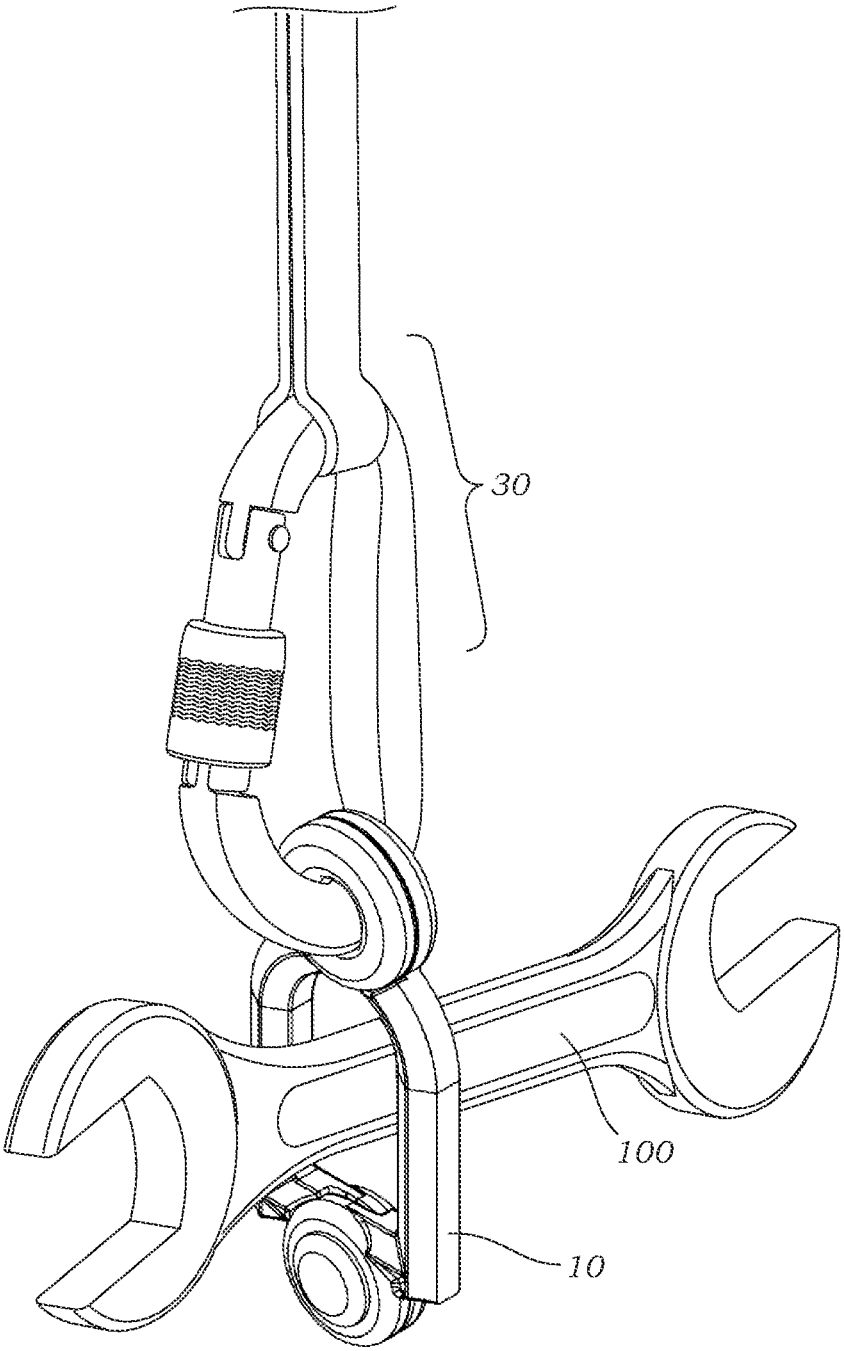
FIG. 14 depicts the tool attachment attached to an open-ended wrench and connected to a tool tether in perspective according to various examples of the present invention.
Figure 15:
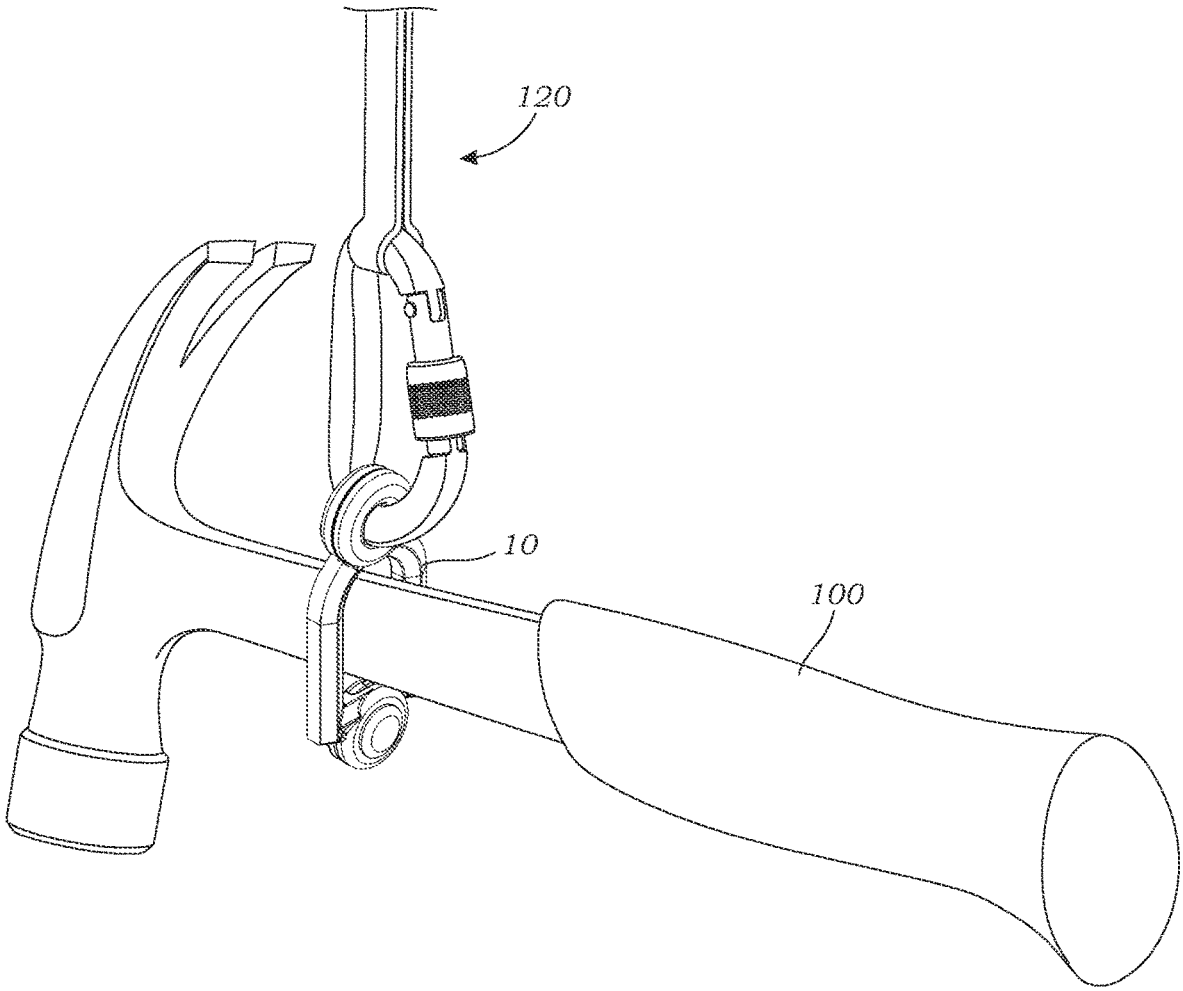
FIG. 15 depicts the tool attachment attached to an open-ended hammer and connected to a tool tether in perspective according to various examples of the present invention.
Figure 16:
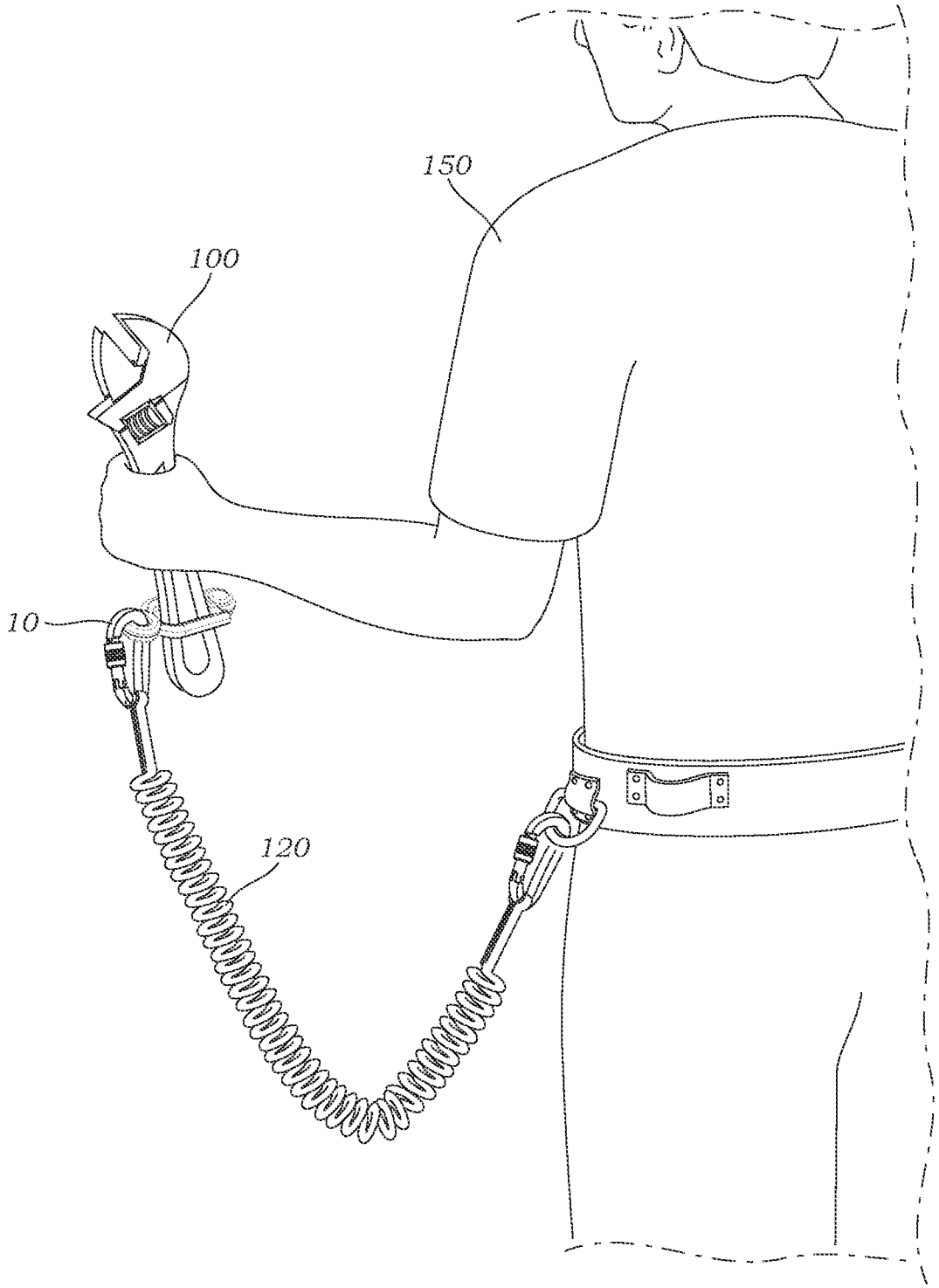
FIG. 16 depicts the tool attachment attached to an open-ended wrench and connected to a tool tether and a user.

Referring to FIGS. 1-16, shows the invention a tool cuff device. FIG. 1 is a prospective view of the invention a tool cuff safety accessory device. FIG. 2 is a prospective view of a tool cuff safety accessory device that has been swiveled open for receiving a tool. FIG. 3 is an exploded view of a tool cuff safety accessory device that has been swiveled open and that is showing the internal and external parts. FIG. 4 is a prospective view of the invention a tool cuff safety accessory device having an internal stopping mechanism. FIG. 5 is a prospective view of a tool cuff safety accessory device having an internal stopping mechanism that has been swiveled open for receiving a tool. FIG. 6 is a prospective view of the invention a tool cuff safety accessory device having an external stopping mechanism. FIG. 7 is a prospective view of a tool cuff safety accessory device having an external stopping mechanism that has been swiveled open for receiving a tool. FIGS. 8-10 are prospective views of the tool cuff safety accessory device in different sizes and shapes. FIGS. 11-13 are prospective views of the tool cuff safety accessory device in different sizes and shapes for attaching to a tool, wherein the FIG. 13 is showing the device attached to a tool. FIG. 14 depicts the tool attachment attached to an open-ended wrench and connected to a tool tether in perspective according to various examples of the present invention. FIG. 15 depicts the tool attachment attached to an open-ended hammer and connected to a tool tether in perspective according to various examples of the present invention. FIG. 16 depicts the tool attachment attached to an open-ended wrench and connected to a tool tether and a user.

Figure 17:
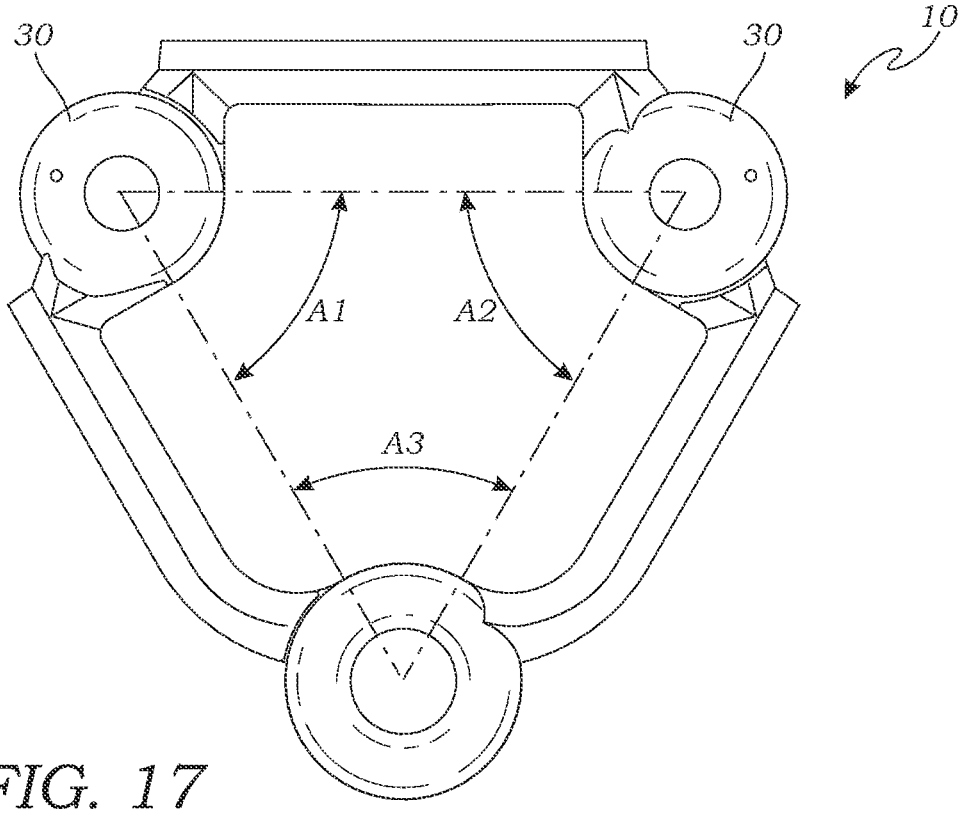
FIG. 17 shows an alternative embodiment of the tool cuff safety accessory device.
Figure 18:
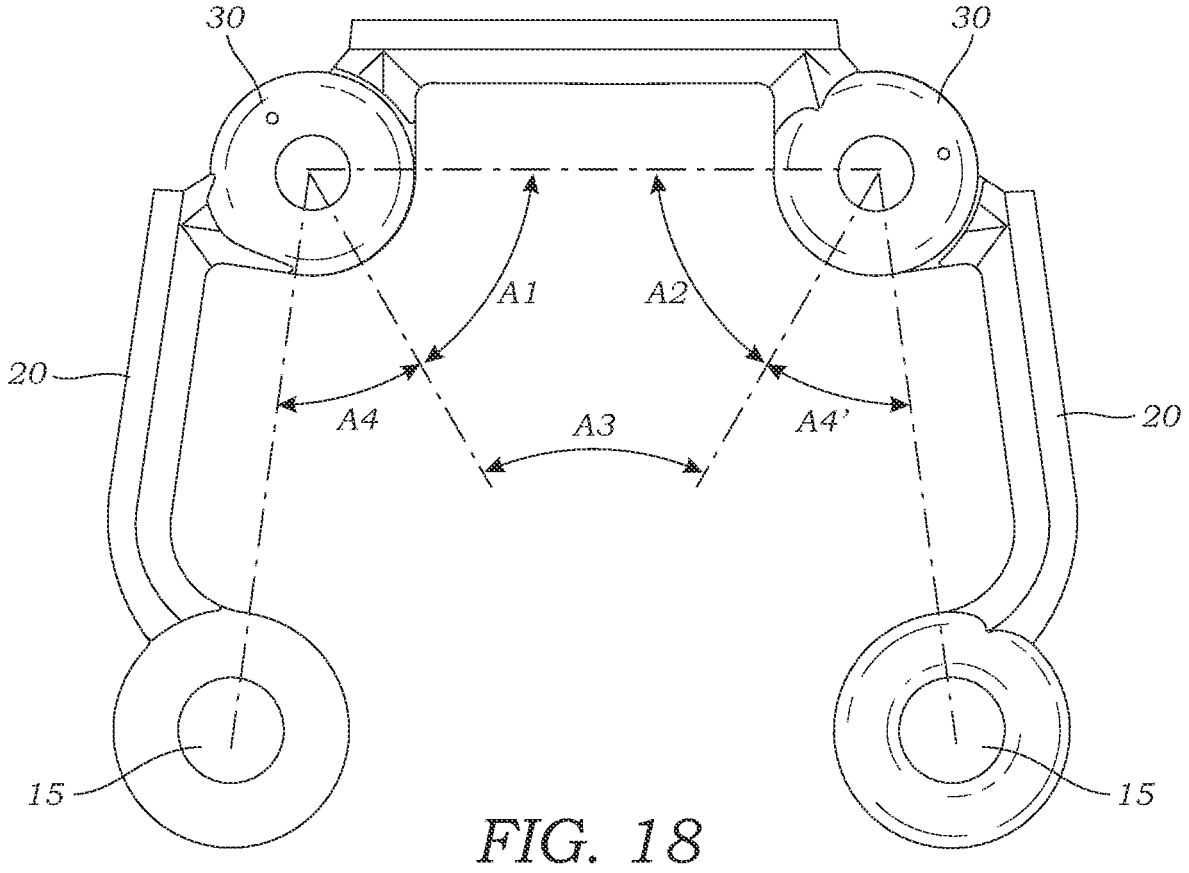
FIG. 18 shows an alternative embodiment of the tool cuff safety accessory device that has been opened.
Figure 19:
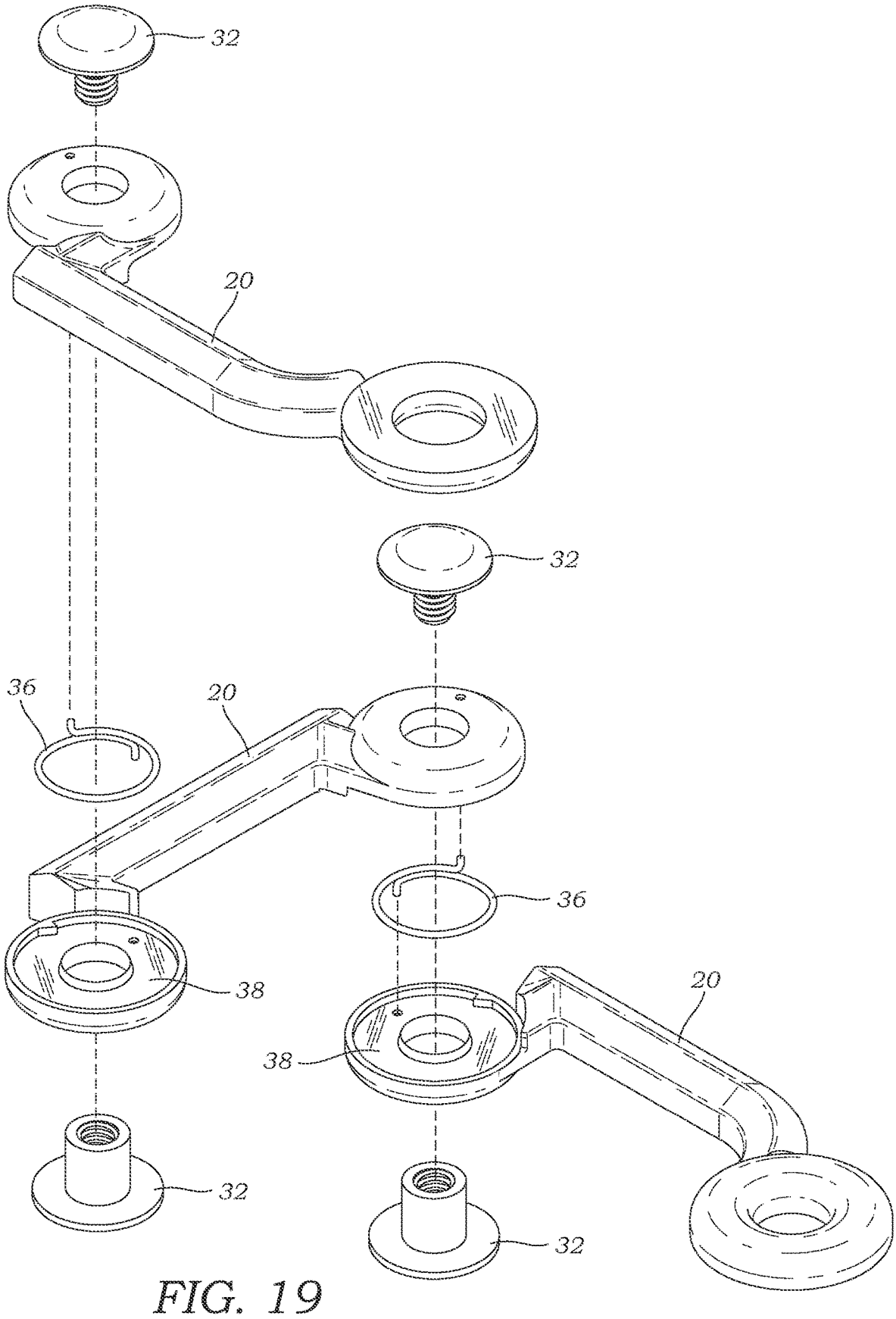
FIG. 19 is an exploded view of an alternative embodiment of a tool cuff safety accessory device that has been swiveled open and that is showing the internal and external parts.

FIG. 17 shows an alternative embodiment of the tool cuff safety accessory device. FIG. 18 shows an alternative embodiment of the tool cuff safety accessory device that has been opened. FIG. 19 is an exploded view of an alternative embodiment of a tool cuff safety accessory device that has been swiveled open and that is showing the internal and external parts.

A Tool Attachment Safety Accessory Device comprising: a tool cuff 10 having a minimum of two inter-connecting pieces 20 that connects at one or more fulcrum(s) 30 which swivel to open and closed for accepting, removing, and locking a hand tool 100 onto the inside said tool cuff 10 thereby creating an enclosure 40 for securing said hand tool 100; said fulcrum 30 has a fastener 32 for securing said two inter-connecting 20 pieces together; a spring 36 that is contained within a cavity 38 of each of said fulcrum(s) 30, thereby creating a locking mechanism for keeping said two inter-connecting pieces 20 closed and attached to said hand tool 100 when not in use; a stop bar 60 which limits the opening distance of the swivel of said two inter-connecting pieces 20, which is used as a sizing tool for selecting the correct size of the tool cuff 10 based on the size of the connecting position of said hand tool 100; and wherein said tool cuff 10 has a captive eye attachment point 15 for tethering and attaching a tether 120 between a user 150 and said user's hand tool 100.

A method of using a tool cuff device for tethering to a hand tool comprising the steps of: providing a tool cuff 10 having a minimum of two inter-connecting pieces 20 that connects to at one or more fulcrum(s) 30, which have a spring 36 that is contained within a cavity 38 of each of said fulcrum(s) 30, which swivel to open and closed for accepting, removing, and locking a hand tool 100 onto the inside said tool cuff 10 thereby creating an enclosure 40 for securing said hand tool 100, and said hand tool 100 has a tapered section 105 for allowing said tool cuff 10 to hold, retain, and secure said hand tool 100, and providing a tether 120 between a user 150 and said tool cuff 10 which is secured to said user's hand tool 100; opening said tool cuff 10 by swiveling open said two inter-connecting pieces 20 from one or more fulcrum(s) 30 thereby creating an opening for accepting said hand tool 100 and then inserting said hand tool 100 into said tool cuff 10; closing said tool cuff 10 by swiveling closed said two inter-connecting pieces 20 from one or more fulcrum(s) 30 for securing said hand tool 100 into the inside said tool cuff 10 thereby creating an enclosure for securing said hand tool 100; attaching said tether 120 to said user 150 and also to said tool cuff 10 which secured said hand tool 100 therein; and wherein if said user 150 accidently drops said hand tool 100 while performing work, said user 150 uses said tether 120 connected to said tool cuff 10 to retrieve said hand tool 100.

Features of the concepts and methods of accomplishing the same may be understood more readily by reference to the following detailed description of examples and the accompanying drawings. References and examples will be described in detail with reference to the accompanying drawings, where reference numbers refer to design elements throughout. The present disclosure, however, may be accomplished in various forms, and should not be construed as being limited to only the illustrated examples shown. These examples are provided as examples so that this disclosure will be thorough and complete, and will fully convey the aspects and features of the present disclosure to those skilled in the art. Additionally, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, thus, descriptions will not be repeated. The drawings are not to scale, the relative sizes of images shown may be exaggerated for clarity. Examples of the present disclosure include a tool attachment for a tool for use with a tool tether that can be attached to a person, anchor point or structure. In some illustrations, the attachment is configured for use with an open-ended wrench. The attachment is configured to allow easy enclosure and removal while allowing normal uninhibited use of the tool.

In various examples the tool attachment is comprised of having at least 2 inter-connecting pieces each having a bottom element and an upper attachment point element, the bottom and top elements are connected by two structural elements forming the enclosure to secure the tool.

With reference to the interior of the tool attachment is shown containing a closure mechanism encased within the inter-connecting piece. The closure mechanism is engaged with each inter-connecting pieces of the inter-connecting pieces are biased toward each other in the closed configuration when assembled. The closure mechanism is received in a receptive aperture encasing the closure mechanism within the two inter-connecting pieces.

In various examples the tool attachment may be connected to connecting device such as a carabiner, tool attachment, or tool tether. Tools may be of different sizes, have different lengths or shapes in various examples.

The inter-connecting pieces are joined by means of a fastener. The connecting pieces can be joined and permanently secured by a variety of means, the fastener can be comprised of a rivet, nut and bolt or retaining clip configuration as shown. Each inner-facing plane of the bottom element and each inner-facing plane of the attachment point element of each inter-connecting piece, when aligned and coincident, form the tool attachment enclosure element with an integral captive attachment point. When such alignment occurs, the user can then connect a connecting device such as carabiner, tool attachment or tool tether to secure the tool onto their person, anchor point or structure as part of a dropped object prevention program.

In the preferred embodiment of the invention, the tool safety accessory device is comprised of: a tool cuff having a minimum of two inter-connecting pieces that connects at one or more fulcrum(s) which swivel to open and closed for accepting, removing, and locking a hand tool onto the inside said tool cuff thereby creating an enclosure for securing said hand tool; said tool cuff has a locking mechanism for keeping said two inter-connecting pieces closed and attached to said hand tool when not in use; a mechanical stop which limits the opening distance of the swivel of said two inter-connecting pieces, which is used as a sizing tool for selecting the correct size of the tool cuff based on the size of the connecting position of said hand tool; and said tool cuff has mean for attaching a tether between a user and said user's hand tool.

A tool attachment safety accessory device comprising: a tool cuff having a minimum of two inter-connecting pieces that connects at one or more fulcrum(s) which swivel to open and closed for accepting, removing, and locking a hand tool into the inside said tool cuff thereby creating an enclosure for securing said hand tool; and said tool cuff has mean for attaching a tether between a user and said user's hand tool.

Wherein said tool cuff is made of a rigid or semi-rigid material.

Wherein said tool cuff is made of a material selected from the group consisting of metal, plastic and composite.

Wherein said hand tool has a tapered section for allowing said tool cuff to hold, retain, and secure said hand tool.

Wherein said hand tool has a closed handle for allowing said tool cuff to hold, retain, and secure onto said hand tool.

Wherein said hand tool has an enclosure for allowing said tool cuff to hold, retain, and secure onto said hand tool.

Wherein said hand tool is wherein said hand tool is selected from the group consisting of hammer, striking hammer, mallet, power drill, drill, power saw, saw, wrench, adjustable wrench, spud wrench, torpedo wrench, screwdriver, chisel, file, plier and flashlight.

Further comprising said tool cuff having a tether tab for attaching a tether to a user and to said tool cuff.

Wherein said tether is selected from a group consisting of choke loop, strap loop, fixed tether, and extendable tether.

Further comprising a return spring for keeping said two inter-connecting pieces closed and attached to said hand tool when not in use; wherein said user elects to open said tool cuff for inserting said hand tool inside said tool cuff, said return spring creates tension when opening of said two inter-connecting pieces for accepting said hand tool and then after said hand tool is inserted said return spring will swivel said two inter-connecting pieces closed for enclosing and retaining said hand tool; and wherein said return spring creates tension when opening said two inter-connecting pieces for removing said hand tool.

Further comprising a locking mechanism for keeping said two inter-connecting pieces closed and attached to said hand tool when not in use.

Wherein said tool cuff having said fulcrum further comprises a mechanical stop which limits the opening distance of the swivel of said two inter-connecting pieces, which is used as a sizing tool for selecting the correct size of the tool cuff based on the size of the connecting position of said hand tool; wherein a larger tool cuff would produce a larger opening distance when swiveled open for said two inter-connecting pieces to accept a larger connecting position for said tool cuff on said hand tool; and wherein a smaller tool cuff would produce a smaller opening distance when swiveled open for said two inter-connecting pieces to accept a smaller connecting position for said tool cuff on said hand tool.

Wherein said mechanical stop which limits the opening distance of said swivel of said two inter-connecting pieces is an external located protrusion that stops said pieces from swiveling an even greater distance.

Wherein said mechanical stop which limits the opening distance of said swivel of said two inter-connecting pieces is an internally located protrusion that stops said pieces from swiveling an even greater distance.

A method of using a tool cuff device for tethering to a hand tool comprising the steps of: providing a tool cuff having a minimum of two inter-connecting pieces that connects to at one or more fulcrum(s) which swivel to open and closed for accepting, removing, and locking a hand tool onto the inside said tool cuff thereby creating an enclosure for securing said hand tool; providing means for attaching a tether between a user and said tool cuff which is secured to said user's hand tool; opening said tool cuff by swiveling open said two inter-connecting pieces from one or more fulcrum(s) thereby creating an opening for accepting said hand tool and then inserting said hand tool into said tool cuff; losing said tool cuff by swiveling closed said two inter-connecting pieces from one or more fulcrum(s) for securing said hand tool into the inside said tool cuff thereby creating an enclosure for securing said hand tool; attaching said tether to said user and also to said tool cuff which secured said hand tool therein; and wherein if said user accidently drops said hand tool while performing work, said user uses said tether connected to said tool cuff to retrieve said hand tool.

The method of claim 1, wherein said tool cuff has a tether tab for attaching said tether between said user and said tool cuff which is secured to said hand tool.

The method of claim 1, wherein said tool cuff having said fulcrum further comprises a mechanical stop which limits the opening distance of the swivel of said two inter-connecting pieces, which is used as a sizing tool for selecting the correct size of the tool cuff based on the size of the connecting position of said hand tool; wherein a larger tool cuff would produce a larger opening distance when swiveled open for said two inter-connecting pieces to accept a larger connecting position for said tool cuff on said hand tool; and wherein a smaller tool cuff would produce a smaller opening distance when swiveled open for said two inter-connecting pieces to accept a smaller connecting position for said tool cuff on said hand tool.

The method of claim 1, further comprising a return spring for keeping said two inter-connecting pieces closed and attached to said hand tool when not in use; wherein said user elects to open said tool cuff for inserting said hand tool inside said tool cuff, said return spring creates tension when opening of said two inter-connecting pieces for accepting said hand tool and then after said hand tool is inserted said return spring will swivel said two inter-connecting pieces closed for enclosing and retaining said hand tool; wherein said return spring creates tension when opening said two inter-connecting pieces for removing said hand tool.

The method of claim 1, further comprising a locking mechanism for keeping said two inter-connecting pieces swiveled closed and attached to said hand tool when not in use.

Wherein said a locking mechanism is comprising a return spring for keeping said two inter-connecting pieces closed and attached to said hand tool when not in use; wherein said user elects to open said tool cuff for inserting said hand tool inside said tool cuff, said return spring creates tension when opening of said two inter-connecting pieces for accepting said hand tool and then after said hand tool is inserted said return spring will swivel said two inter-connecting pieces closed for enclosing and retaining said hand tool; and wherein said user elects to open said tool cuff for removing said hand tool inside said tool cuff, said return spring creates tension when opening said two inter-connecting pieces for removing said hand tool and then after said hand tool is removed, said return spring will swivel said two inter-connecting pieces closed.

Wherein said mechanical stop which limits the opening distance of said swivel of said two inter-connecting pieces is an external located protrusion that stops said pieces from swiveling an even greater distance.

Wherein said mechanical stop which limits the opening distance of said swivel of said two inter-connecting pieces is an internally located protrusion that stops said pieces from swiveling an even greater distance.

Wherein said hand tool has a tapered section for allowing said tool cuff to hold, retain, and secure said hand tool.

Wherein said hand tool has a closed handle for allowing said tool cuff to hold, retain, and secure onto said hand tool.

Wherein said hand tool has an enclosure for allowing said tool cuff to hold, retain, and secure onto said hand tool.

Wherein said hand tool is selected from a group consisting of hammer, striking hammer, mallet, power drill, drill, power saw, saw, wrench, adjustable wrench, spud wrench, torpedo wrench, screwdriver, chisel, file, plier and flashlight.

While the description above refers to a particular embodiment of the present invention, it will be understood that many modifications may be made without departing from the spirit thereof. The presently disclosed embodiments are therefore to be considered in all respects as illustrative and not restrictive.

The invention claimed is:

1. A method of using a tool cuff device for tethering to a hand tool comprising the steps of:

providing a tool cuff having a minimum of two inter-connecting pieces that connects to at one or more fulcrum(s) which swivel to open and closed for accepting, removing, and locking a hand tool onto the inside said tool cuff thereby creating an enclosure for securing said hand tool and said fulcrum has a fastener for securing said two inter-connecting pieces together and a captive eye attachment point for tethering;

providing means for attaching a tether between a user and said tool cuff which is secured to said user's hand tool;

opening said tool cuff by swiveling open said two inter-connecting pieces from one or more fulcrum(s) thereby creating an opening for accepting said hand tool and then inserting said hand tool into said tool cuff;

closing said tool cuff by swiveling closed said two inter-connecting pieces from one or more fulcrum(s) for securing said hand tool into the inside said tool cuff thereby creating an enclosure for securing said hand tool;

attaching said tether to said user and also to said tool cuff which secured said hand tool therein; and wherein if said user accidently drops said hand tool while performing work, said user uses said tether connected to said tool cuff to retrieve said hand tool.

2. The method of claim 1, wherein said tool cuff has a tether tab for attaching said tether between said user and said tool cuff which is secured to said hand tool.

3. The method of claim 1, wherein said tool cuff having said fulcrum further comprises a mechanical stop which limits the opening distance of the swivel of said two inter-connecting pieces, which is used as a sizing tool for selecting the correct size of the tool cuff based on the size of the connecting position of said hand tool;

wherein a larger tool cuff would produce a larger opening distance when swiveled open for said two inter-connecting pieces to accept a larger connecting position for said tool cuff on said hand tool; and wherein a smaller tool cuff would produce a smaller opening distance when swiveled open for said two inter-connecting pieces to accept a smaller connecting position for said tool cuff on said hand tool.

4. The method of claim 1, further comprising a return spring for keeping said two inter-connecting pieces closed and attached to said hand tool when not in use;

wherein said user elects to open said tool cuff for inserting said hand tool inside said tool cuff, said return spring creates tension when opening of said two inter-connecting pieces for accepting said hand tool and then after said hand tool is inserted said return spring will swivel said two inter-connecting pieces closed for enclosing and retaining said hand tool;

wherein said return spring creates tension when opening said two inter-connecting pieces for removing said hand tool.

5. The method of claim 1, further comprising a locking mechanism for keeping said two inter-connecting pieces swiveled closed and attached to said hand tool when not in use.

6. The method of claim 5, wherein said a locking mechanism is comprising a return spring for keeping said two inter-connecting pieces closed and attached to said hand tool when not in use;

wherein said user elects to open said tool cuff for inserting said hand tool inside said tool cuff, said return spring creates tension when opening of said two inter-connecting pieces for accepting said hand tool and then after said hand tool is inserted said return spring will swivel said two inter-connecting pieces closed for enclosing and retaining said hand tool; and wherein said user elects to open said tool cuff for removing said hand tool inside said tool cuff, said return spring creates tension when opening said two inter-connecting pieces for removing said hand tool and then after said hand tool is removed, said return spring will swivel said two inter-connecting pieces closed.

7. The method of claim 3, wherein said mechanical stop which limits the opening distance of said swivel of said two inter-connecting pieces is an external located protrusion that stops said pieces from swiveling an even greater distance.

8. The method of claim 3, wherein said mechanical stop which limits the opening distance of said swivel of said two inter-connecting pieces is an internally located protrusion that stops said pieces from swiveling an even greater distance.

9. The method of claim 1, wherein said hand tool has a tapered section for allowing said tool cuff to hold, retain, and secure said hand tool.

10. The method of claim 1, wherein said hand tool has a closed handle for allowing said tool cuff to hold, retain, and secure onto said hand tool.

11. The method of claim 1, wherein said hand tool has an enclosure for allowing said tool cuff to hold, retain, and secure onto said hand tool.

12. The method of claim 1, wherein said hand tool is selected from a group consisting of hammer, striking hammer, mallet, power drill, drill, power saw, saw, wrench, adjustable wrench, spud wrench, torpedo wrench, screwdriver, chisel, file, plier and flashlight.

13. A method of using a tool cuff device for tethering to a hand tool comprising the steps of:

providing a tool cuff having a minimum of two inter-connecting pieces that connects to at one or more fulcrum(s), which have a spring that is contained within a cavity of each of said fulcrum(s), which swivel to open and closed for accepting, removing, and locking a hand tool onto the inside said tool cuff thereby creating an enclosure for securing said hand tool, and said hand tool has a tapered section for allowing said tool cuff to hold, retain, and said fulcrum has a fastener for securing said two inter-connecting pieces together, and secure said hand tool and a captive eye attachment point for tethering;

providing a tether between a user and said tool cuff which is secured to said user's hand tool;

opening said tool cuff by swiveling open said two inter-connecting pieces from one or more fulcrum(s) thereby creating an opening for accepting said hand tool and then inserting said hand tool into said tool cuff;

closing said tool cuff by swiveling closed said two inter-connecting pieces from one or more fulcrum(s) for securing said hand tool into the inside said tool cuff thereby creating an enclosure for securing said hand tool;

attaching said tether to said user and also to said tool cuff which secured said hand tool therein; and wherein if said user accidently drops said hand tool while performing work, said user uses said tether connected to said tool cuff to retrieve said hand tool.

14. The method of claim 13, further comprising a return spring for keeping said two inter-connecting pieces closed and attached to said hand tool when not in use;

wherein said user elects to open said tool cuff for inserting said hand tool inside said tool cuff, said return spring creates tension when opening of said two inter-connecting pieces for accepting said hand tool and then after said hand tool is inserted said return spring will swivel said two inter-connecting pieces closed for enclosing and retaining said hand tool; and wherein said user elects to open said tool cuff for removing said hand tool inside said tool cuff, said return spring creates tension when opening said two inter-connecting pieces for removing said hand tool and then after said hand tool is removed, said return spring will swivel said two inter-connecting pieces closed.

15. The method of claim 13, wherein said tool cuff having said fulcrum further comprises a mechanical stop which limits the opening distance of the swivel of said two inter-connecting pieces, which is used as a sizing tool for selecting the correct size of the tool cuff based on the size of the connecting position of said hand tool;

wherein a larger tool cuff would produce a larger opening distance when swiveled open for said two inter-connecting pieces to accept a larger connecting position for said tool cuff on said hand tool; and wherein a smaller tool cuff would produce a smaller opening distance when swiveled open for said two inter-connecting pieces to accept a smaller connecting position for said tool cuff on said hand tool.

16. A method for accurately sizing one or more tool cuff device for use with a hand tool, the method comprising:

providing a tool cuff having a minimum of two inter-connecting pieces that connects at one or more fulcrum(s) which swivel to open and closed for accepting, removing, and locking a hand tool onto the inside said tool cuff thereby creating an enclosure for securing said hand tool; said fulcrum has a locking mechanism for keeping said two inter-connecting pieces closed and attached to a connecting position of said hand tool; and said connecting position of said hand tool has a tapered section for allowing said tool cuff to hold, retain, and secure said hand tool, and said fulcrum has a fastener for securing said two inter-connecting pieces together, and a captive eye attachment point for tethering;

providing mechanical stop which limits the opening distance of the swivel of said two inter-connecting pieces, which is used as a sizing tool for selecting the correct size of the tool cuff based on the size of the connecting position of said hand tool;

wherein said user opens said tool cuff by swiveling open said two inter-connecting pieces from one or more fulcrum(s) thereby creating an opening for accepting said hand tool and then said user can try to insert said hand tool into said tool cuff at said connecting position for accepting and retaining said hand tool;

wherein a smaller tool cuff would produce a smaller opening distance when swiveled open for said two inter-connecting pieces to accept a smaller connecting position for said tool cuff on said hand tool;

wherein a larger tool cuff would produce a larger opening distance when swiveled open for said two inter-connecting pieces to accept a larger connecting position for said tool cuff on said hand tool;

wherein said user would select the size of said tool cuff by checking to see if said connecting position of said hand tool has said tapered section having a greater thickness than said tool cuff, if yes then said hand tool cannot be inserted into said tool cuff and said hand tool cannot be accepted and secured into said tool cuff and then said user has to select a different size for said tool cuff;

wherein said user would select the size of said tool cuff by checking to see if said connecting position of said hand tool has said tapered section that has a less thickness than said tool cuff for retaining said hand tool then said hand tool can be inserted into said tool cuff and so said hand tool can be accepted into said tool cuff;

wherein said hand tool can be accepted into said tool cuff then said user would also need select the size of said tool cuff by checking to see if said hand tool having said tapered section allows said tool cuff to hold, retain, and secure said hand tool where it is tapered in said connecting position, if yes then said user has selected the proper size of said tool cuff, if no then said user would need to select a different size of said hand tool having a smaller tapered portion for being retained by said tool cuff for holding, retaining, and securing said hand tool; and after said user has selected the proper size of said tool cuff, then said hand tool is inserted into said tool cuff and said tool cuff is closed by swiveling said two inter-connecting pieces from one or more fulcrum(s) for securing said hand tool into the inside said tool cuff thereby creating an enclosure for securing said hand tool.

17. The method of claim 16, wherein said mechanical stop which limits the opening distance of said swivel of said two inter-connecting pieces is an external located protrusion that stops said pieces from swiveling an even greater distance.

18. The method of claim 16, wherein said mechanical stop which limits the opening distance of said swivel of said two inter-connecting pieces is an internally located protrusion that stops said pieces from swiveling an even greater distance.

19. The method of claim 16, wherein said locking mechanism is comprising a return spring for keeping said two inter-connecting pieces closed and attached to said hand tool when not in use;

wherein said user elects to open said tool cuff for inserting said hand tool inside said tool cuff, said return spring creates tension when opening of said two inter-connecting pieces for accepting said hand tool and then after said hand tool is inserted said return spring will swivel said two inter-connecting pieces closed for enclosing and retaining said hand tool; and wherein said user elects to open said tool cuff for removing said hand tool inside said tool cuff, said return spring creates tension when opening said two inter-connecting pieces for removing said hand tool and then after said hand tool is removed, said return spring will swivel said two inter-connecting pieces closed.

20. The method of claim 16, wherein said hand tool has a closed handle for allowing said tool cuff to hold, retain, and secure onto said hand tool.

21. The method of claim 16, wherein said hand tool has an enclosure for allowing said tool cuff to hold, retain, and secure onto said hand tool.

* * * * *